US011933298B2

(12) United States Patent
Teshima

(10) Patent No.: US 11,933,298 B2
(45) Date of Patent: Mar. 19, 2024

(54) SCROLL COMPRESSOR

(71) Applicant: SANDEN AUTOMOTIVE COMPONENTS CORPORATION, Isesaki (JP)

(72) Inventor: Atsuo Teshima, Isesaki (JP)

(73) Assignee: SANDEN CORPORATION, Isesaki (JP)

( * ) Notice: Subject to any disclaimer, the term of this patent is extended or adjusted under 35 U.S.C. 154(b) by 202 days.

(21) Appl. No.: 17/615,751

(22) PCT Filed: Jun. 23, 2020

(86) PCT No.: PCT/JP2020/024498
§ 371 (c)(1),
(2) Date: Dec. 1, 2021

(87) PCT Pub. No.: WO2021/010099
PCT Pub. Date: Jan. 21, 2021

(65) Prior Publication Data

US 2022/0316476 A1 Oct. 6, 2022

(30) Foreign Application Priority Data

Jul. 12, 2019 (JP) ..... 2019-130379

(51) Int. Cl.
*F04C 18/02* (2006.01)

(52) U.S. Cl.
CPC ..... *F04C 18/0215* (2013.01)

(58) Field of Classification Search
CPC ..... F04C 18/0215; F04C 18/0261; F04C 23/008; F04C 27/005
See application file for complete search history.

(56) References Cited

U.S. PATENT DOCUMENTS 5,762,483 A * 6/1998 Lifson ..... F04C 18/0292 418/57
2015/0308431 A1 10/2015 Schneider et al.

FOREIGN PATENT DOCUMENTS

JP 58-122386 A 7/1983
JP 58-190591 A 11/1983
(Continued)

OTHER PUBLICATIONS

English Machine Translation of JP-2012241680-A (Year: 2012).*
(Continued)

*Primary Examiner* — Anthony Ayala Delgado
(74) *Attorney, Agent, or Firm* — Baker Botts L.L.P.

(57) ABSTRACT

A scroll compressor is provided which is capable of performing an adjustment to appropriate back pressure in both a low-speed operation condition and an operation condition low in suction pressure by improving the position or dimension of a back pressure hole. The scroll compressor includes a back pressure chamber 29 formed on the back surface of a mirror plate 31 of a movable scroll 22, and back pressure holes 51 and 52 formed in the mirror plate of the movable scroll and providing communication between the back pressure chamber and the compression chamber 34. After the back pressure hole 52 is opened inside a lap 32 of the movable scroll in a first crank angle range, the back pressure hole 52 is temporarily closed by a lap 24 of a fixed scroll 21 and then opened inside the lap of the fixed scroll in a second crank angle range.

9 Claims, 10 Drawing Sheets

(56) References Cited

FOREIGN PATENT DOCUMENTS

| | | | | |
|---|---|---|---|---|
| JP | 2008-101559 | A | | 5/2008 |
| JP | 2010-106780 | A | | 5/2010 |
| JP | 2010-121578 | A | | 6/2010 |
| JP | 2012-188978 | A | | 10/2012 |
| JP | 2012241680 | A | * | 12/2012 |
| JP | 5859480 | B2 | | 2/2016 |

OTHER PUBLICATIONS

Japan Patent Office, Notice of Reasons for Refusal issued in Japanese Patent Application No. 2019-130379, dated May 30, 2023 (10 pages).

Japan Patent Office, International Search Report issued in International Application No. PCT/JP2020/024498, dated Aug. 11, 2020.

The State Intellectual Property Office of the People's Republic of China, First Notice of Reasons for Refusal, issued in Chinese Patent Application No. CN 202080044403.X, dated Jan. 20, 2023.

* cited by examiner

SCROLL COMPRESSOR

CROSS-REFERENCE TO RELATED APPLICATIONS

This application is a U.S. National Stage patent application under 35 U.S.C. § 371 of International Patent Application No. PCT/JP2020/024498, filed on Jun. 23, 2020, which claims the benefit of Japanese Patent Application No. 2019-130379, filed on Jul. 12, 2019, the disclosures of each of which are incorporated herein by reference in their entirety.

TECHNICAL FIELD

The present invention relates to a scroll compressor which compresses a working fluid in a compression chamber formed between laps of both a fixed scroll and a movable scroll by revolving and turning the movable scroll with respect to the fixed scroll.

BACKGROUND ART

This type of scroll compressor conventionally includes a compression mechanism constituted of a fixed scroll having a spiral lap on the surface of a mirror plate and a movable scroll having a spiral lap on the surface of a mirror plate and is configured such that a compression chamber is formed between the laps of the respective scrolls with the laps facing each other, and the movable scroll is revolved and turned with respect to the fixed scroll by a motor to thereby compress a working fluid (refrigerant) in the compression chamber.

In this case, a back pressure chamber for pressing the movable scroll against the fixed scroll against a compression reaction force from the compression chamber is formed in the back surface of the mirror plate of the movable scroll. Conventionally, a back pressure passage causing the discharge side (discharge space) of the compression mechanism and the back pressure chamber to communicate with each other is formed, and an orifice is arranged in this back pressure passage, whereby discharge pressure Pd after being decompressed by the orifice is supplied to the back pressure chamber to apply a back pressure load which overcomes the compression reaction force to the movable scroll (refer to, for example, Patent Document 1).

Further, in Patent Document 1, a hole (back pressure hole) for pressure control is formed in the mirror plate of the movable scroll. With the formation of this back pressure hole, a refrigerant and oil having flowed into the back pressure chamber from the back pressure passage are returned to the compression chamber, and for example, in an operating state where suction pressure Ps is low, the pressure (back pressure Pm) in the back pressure chamber is adjusted not to be excessive.

CITATION LIST

Patent Document

Patent Document 1: Japanese Patent No. 5859480

SUMMARY OF THE INVENTION

Problems to be Solved by the Invention

Here, FIGS. 9 and 10 show the relationship between the opening characteristics of back pressure holes (H1 and H2) formed in a movable scroll of a conventional scroll compressor and the pressure characteristics of each part. Incidentally, in this case, it is assumed that the two back pressure holes H1 and H2 are formed in the movable scroll.

The back pressure holes H1 and H2 are opened and closed by a lap of a fixed scroll with revolution turning motion of the movable scroll, but conventionally, both back pressure holes H1 and H2 have been configured to open in the range of a crank angle of 25° to 230°, for example. Therefore, under a low-speed operation condition, the opening time of each of the back pressure holes H1 and H2 becomes long, the refrigerant and oil flow from a back pressure chamber into a compression chamber, and compression chamber pressure rises as shown in FIG. 9. Correspondingly, the back pressure Pm (back pressure chamber pressure) also increases. For that reason, the movable scroll is excessively pressed against the fixed scroll, and power consumption increases. Therefore, conventionally, it is necessary to provide a pressure control valve (PCV) for releasing the back pressure to a suction chamber, thus causing a problem that the cost rises.

On the other hand, a problem arises in that under the operation condition where the suction pressure Ps becomes low, the compression chamber pressure in a section communicating with the back pressure holes H1 and H2 becomes low, so that the back pressure Pm (back pressure chamber pressure) does not rise either as shown in FIG. 10, and the force to press the movable scroll against the fixed scroll runs short, thereby causing compression failure.

The present invention has been made to solve the above-mentioned conventional technical problems, and an object thereof is to provide a scroll compressor capable of performing an adjustment to appropriate back pressure in both a low-speed operation condition and an operation condition low in suction pressure by improving the position or dimension of a back pressure hole.

Means for Solving the Problems

A scroll compressor of the present invention is provided which includes a compression mechanism constituted of a fixed scroll and a movable scroll respectively formed at surfaces of mirror plates with spiral laps facing each other, and in which the movable scroll is revolved and turned with respect to the fixed scroll to thereby compress a working fluid in a compression chamber formed between the laps of both scrolls. The scroll compressor is characterized by having a back pressure chamber formed in a back surface of the mirror plate of the movable scroll, and a back pressure hole formed in the mirror plate of the movable scroll and communicating the back pressure chamber and the compression chamber with each other, and in that the back pressure hole is formed in a position and/or dimension where by the revolution turning motion of the movable scroll, after the back pressure hole is opened inside the lap of the movable scroll in a predetermined first crank angle range, the back pressure hole is temporarily closed by the lap of the fixed scroll and then opened inside the lap of the fixed scroll in a predetermined second crank angle range.

The scroll compressor of the invention of claim 2 is characterized in that in the above invention, the back pressure hole is opened in a range of crank angles 25° to 175° and 250° to 310°.

The scroll compressor of the invention of claim 3 is characterized in that in the above respective inventions, a first back pressure hole and a second back pressure hole are formed in the mirror plate of the movable scroll, the first back pressure hole is formed in a position and/or dimension where by the revolution turning motion of the movable scroll, the first back pressure hole is opened inside the lap of the fixed scroll and then closed by the lap of the fixed scroll, and the second back pressure hole is formed in a position and/or dimension where by the revolution turning motion of the movable scroll, after the second back pressure hole is opened inside the lap of the movable scroll in the first crank angle range, the second back pressure hole is temporarily closed by the lap of the fixed scroll and then opened inside the lap of the fixed scroll in the second crank angle range.

The scroll compressor of the invention of claim 4 is characterized in that in the above invention, the first back pressure hole is formed in a position and/or dimension where by the revolution turning motion of the movable scroll, after the first back pressure hole is opened inside the lap of the fixed scroll, the first back pressure hole is closed by the lap of the fixed scroll and then is not opened outside the lap of the fixed scroll.

The scroll compressor of the invention of claim 5 is characterized in that in the invention of claim 3 or 4, the first back pressure hole is opened in the range of the crank angle of 25° to 215°, and the second back pressure hole is opened in the range of the crank angles 25° to 175° and 250° to 310°.

The scroll compressor of the invention of claim 6 is characterized in the above respective inventions by including a back pressure passage which communicates the discharge side of the compression mechanism and the back pressure chamber with each other, and a pressure reducing section provided in the back pressure passage.

Advantageous Effect of the Invention

According to the present invention, there is provided a scroll compressor having a compression mechanism constituted of a fixed scroll and a movable scroll respectively formed at surfaces of mirror plates with spiral laps facing each other, and in which the movable scroll is revolved and turned with respect to the fixed scroll to thereby compress a working fluid in a compression chamber formed between the laps of both scrolls. The scroll compressor includes a back pressure chamber formed in a back surface of the mirror plate of the movable scroll, and a back pressure hole formed in the mirror plate of the movable scroll and communicating the back pressure chamber and the compression chamber with each other. The back pressure hole is formed in a position and/or dimension where by the revolution turning motion of the movable scroll, after the back pressure hole is opened inside the lap of the movable scroll in a predetermined first crank angle range, the back pressure hole is temporarily closed by the lap of the fixed scroll and then opened inside the lap of the fixed scroll in a predetermined second crank angle range. It is therefore possible to make the first crank angle range in which the back pressure hole opens narrower than conventional, shorten the time at which the back pressure hole opens under a low-speed operation condition, and suppress the amount of a refrigerant and oil flowing from the back pressure chamber into the compression chamber. Consequently, it is possible to suppress a rise in the back pressure due to an increase in the compression chamber pressure.

On the other hand, since the back pressure hole is then reopened in the second crank angle range, the back pressure chamber and the compression chamber are communicated with each other after the compression chamber pressure has risen sufficiently. Consequently, higher compression chamber pressure can be supplied to the back pressure chamber, and a decrease in back pressure under an operation condition in which suction pressure becomes low can also be suppressed.

From the above, according to the present invention, while adjusting the back pressure to appropriate back pressure under both the low-speed operation condition and the operation condition low in suction pressure, and eliminating the inconvenience of excessively pressing the movable scroll against the fixed scroll under the low-speed operation condition to increase power consumption, and an increase in cost, it is also possible to eliminate the inconvenience that the back pressure is lowered under the operation condition in which the suction pressure becomes low, and the force to press the movable scroll against the fixed scroll runs short, thereby causing compression failure.

In this case, it is effective to open the back pressure hole in a range of crank angles of 25° to 175° and 250° to 310° as in the invention of claim 2, for example.

Further, as in the invention of claim 3, in the scroll compressor provided with a first back pressure hole and a second back pressure hole, the first back pressure hole may be formed in a position and/or dimension where the first back pressure hole is opened inside the lap of the fixed scroll and then closed by the lap of the fixed scroll. The second back pressure hole may be formed in a position and/or dimension where after the second back pressure hole is opened inside the lap of the movable scroll in the first crank angle range, the second back pressure hole is temporarily closed by the lap of the fixed scroll and then opened inside the lap of the fixed scroll in the second crank angle range.

Further, as in the invention of claim 4, the first back pressure hole is formed in a position and/or dimension where by the revolution turning motion of the movable scroll, after the first back pressure hole is opened inside the lap of the fixed scroll, the first back pressure hole is closed by the lap of the fixed scroll and then is not opened outside the lap of the fixed scroll. This therefore does not cause inconvenience either that the first back pressure hole communicates with the compression chamber low in pressure.

Also in this case, as in the invention of claim 5, it is effective to open the first back pressure hole in the range of the crank angle of 25° to 215° and open the second back pressure hole in the range of the crank angles of 250 to 175° and 250° to 310°.

Then, the above invention is extremely suitable for the scroll compressor including a back pressure passage which communicates the discharge side of the compression mechanism and the back pressure chamber with each other, and a pressure reducing section provided in the back pressure passage as in the invention of claim 6.

MODE FOR CARRYING OUT THE INVENTION

Figure 1:
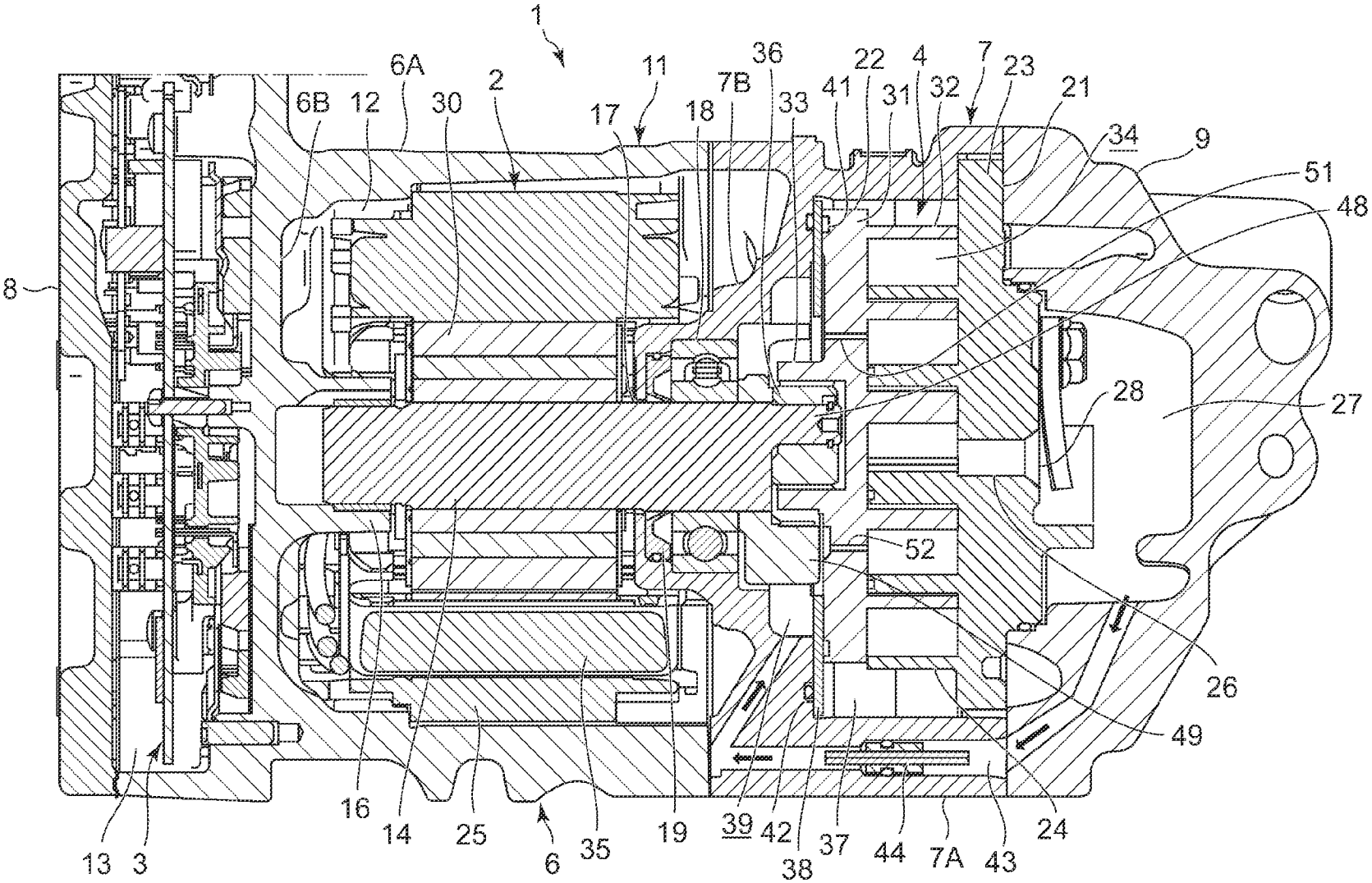
FIG. 1 is a cross-sectional diagram of a scroll compressor of an embodiment to which the present invention is applied.

Hereinafter, embodiments of the present invention will be described in detail with reference to the drawings. FIG. 1 is a cross-sectional diagram of a scroll compressor 1 of an embodiment to which the present invention is applied. The scroll compressor 1 of the embodiment is, for example, a so-called inverter-integrated scroll compressor which is used in a refrigerant circuit of a vehicle air conditioning device, sucks a refrigerant as a working fluid of the vehicle air conditioning device, and compresses and discharges it, and which includes an electric motor 2, an inverter 3 for operating the electric motor 2, and a compression mechanism 4 driven by the electric motor 2.

The scroll compressor 1 of the embodiment includes a man housing 6 which accommodates the electric motor 2 and the inverter 3 thereinside, a compression mechanism housing 7 which accommodates the compression mechanism 4 thereinside, an inverter cover 8, and a compression mechanism cover 9. Then, the main housing 6, the compression mechanism housing 7, the inverter cover 8, and the compression mechanism cover 9 of these are all made of metal (made of aluminum in the embodiment). They are integrally joined to constitute a housing 11 of the scroll compressor 1.

The main housing 6 is constituted of a tubular peripheral wall portion 6A and a partition wall portion 6B. This partition wall portion 6B is a partition wall which partitions the inside of the main housing 6 into a motor accommodating portion 12 accommodating the electric motor 2 therein and an inverter accommodating portion 13 accommodating the inverter 3 therein. The inverter accommodating portion 13 has one end surface which is open, and this opening is closed by the inverter cover 8 after the inverter 3 is accommodated therein.

The motor accommodating portion 12 also has the other end surface which is open, and this opening is closed by the compression mechanism housing 7 after the electric motor 2 is accommodated therein. A support portion 16 for supporting one end portion (end portion on the side opposite to the compression mechanism 4) of a rotating shaft 14 of the electric motor 2 is protrusively provided at the partition wall portion 6B.

The compression mechanism housing 7 has an opening on the side opposite to the main housing 6, and this opening is closed by the compression mechanism cover 9 after the compression mechanism 4 is accommodated therein. The compression mechanism housing 7 is constituted of a tubular peripheral wall portion 7A and a frame portion 7B on one end side (main housing 6 side) thereof. The compression mechanism 4 is accommodated in a space partitioned by these peripheral wall portion 7A and frame portion 7B. The frame portion 7B forms a partition wall which partitions the inside of the main housing 6 from the inside of the compression mechanism housing 7.

Further, the frame portion 7B is provided with a through hole 17 to insert the other end of the rotating shaft 14 of the electric motor 2 (the end on the compression mechanism 4 side). A front bearing 18 as a bearing member, which supports the other end of the rotating shaft 14, is fitted to the compression mechanism 4 side of the through hole 17. In addition, reference numeral 19 indicates a seal material which seals the outer peripheral surface of the rotating shaft 14 and the inside of the compression mechanism housing 7 at the through hole 17 portion.

The electric motor 2 is constituted of a stator 25 around which a coil 35 is wound and a rotor 30. Then, for example, a direct current from a battery (not shown) of a vehicle is converted into a three-phase alternating current by the inverter 3, which is supplied to the coil 35 of the electric motor 2, so that the rotor 30 is configured to be rotationally driven.

Further, an unillustrated suction port is formed in the main housing 6. After the refrigerant sucked from the suction port passes through the inside of the main housing 6, the refrigerant is sucked into a suction portion 37 to be described later outside the compression mechanism 4 in the compression mechanism housing 7. Thus, the electric motor 2 is cooled by the sucked refrigerant. In addition, the refrigerant compressed by the compression mechanism 4 is configured to be discharged from a discharge space 27 described later as a discharge side of the compression mechanism 4 through an unillustrated discharge port formed in the compression mechanism cover 9.

The compression mechanism 4 is constituted of a fixed scroll 21 and a movable scroll 22. The fixed scroll 21 integrally has a disk-shaped mirror plate 23 and a spiral lap 24 comprised of an involute shape or a curved line approximated thereto, which stands on the surface (one surface) of the mirror plate 23. The surface of the mirror plate 23 on which the lap 24 is vertically provided is fixed to the compression mechanism housing 7 as the frame portion 7B side. A discharge hole 26 is formed in the center of the mirror plate 23 of the fixed scroll 21. The discharge hole 26 is in communication with the discharge space 27 in the compression mechanism cover 9. Reference numeral 28 denotes a discharge valve provided in the opening on the back surface (the other surface) side of the mirror plate 23 in the discharge hole 26.

The movable scroll 22 is a scroll which revolves and turns with respect to the fixed scroll 21, and integrally includes a disk-shaped mirror plate 31, a spiral lap 32 comprised of an involute shape or a curved line approximated thereto, which stands on the surface (one surface) of the mirror plate 31, and a boss portion 33 formed to protrude in the center of the back surface (the other surface) of the mirror plate 31. The movable scroll 22 is arranged so that the lap 32 faces the lap 24 of the fixed scroll 21 and they face each other and mesh with each other with the protruding direction of the lap 32 as the fixed scroll 21 side, and a compression chamber 34 is formed between the laps 24 and 32.

That is, the lap 32 of the movable scroll 22 faces the lap 24 of the fixed scroll 21 and meshes with the lap 24 so that the tip of the lap 32 comes into contact with the surface of the mirror plate 23 and the tip of the lap 24 comes into contact with the surface of the mirror plate 31. The other end of the rotating shaft 14, that is, the end on the movable scroll 22 side is provided with a columnar drive protrusion 48 which protrudes at a position eccentric from the axial center of the rotating shaft 14. Then, a columnar eccentric bush 36 is also attached to the drive protrusion 48 and provided eccentrically from the axial center of the rotating shaft 14 at the other end of the rotating shaft 14.

In this case, the eccentric bush 36 is attached to the drive protrusion 48 at a position eccentric from the axial center of the eccentric bush 36. The eccentric bush 36 is fitted to the boss portion 33 of the movable scroll 22. Then, when the rotating shaft 14 is rotated together with the rotor 30 of the electric motor 2, the movable scroll 22 is configured to revolve and turn with respect to the fixed scroll 21 without rotating on its axis. Incidentally, reference numeral 49 indicates a balance weight attached to the outer peripheral surface of the rotating shaft 14 on the movable scroll 22 side from the front bearing 18.

Since the movable scroll 22 revolves and turns eccentrically with respect to the fixed scroll 21, the eccentric direction and the contact position of each of the laps 24 and 32 are moved while rotating, and the compression chamber 34 having sucked the refrigerant from the above-mentioned suction portion 37 on the outside (compression chamber pressure: suction pressure Ps) gradually shrinks while moving toward the inside. Consequently, the refrigerant is compressed and finally discharged from the central discharge hole 26 to the discharge space 27 through the discharge valve 28 as discharge pressure Pd (compression chamber pressure).

In FIG. 1, reference numeral 38 is an annular thrust plate. The thrust plate 38 is for partitioning a back pressure chamber 39 formed in the back surface side of the mirror plate 31 of the movable scroll 22 and the suction portion 37 as a suction pressure region outside the compression mechanism 4 in the compression mechanism housing 7. The thrust plate 38 is located outside the boss portion 33 and interposed between the frame portion 7B and the movable scroll 22. Reference numeral 41 is a seal material which is attached to the back surface of the mirror plate 31 of the movable scroll 22 and abuts against the thrust plate 38. The back pressure chamber 39 and the suction portion 37 are partitioned by the seal material 41 and the thrust plate 38.

Incidentally, reference numeral 42 is a seal material which is attached to the surface of the frame portion 7B on the thrust plate 38 side, abuts against the outer peripheral portion of the thrust plate 38, and seals between the frame portion 7B and the thrust plate 38.

Also, in FIG. 1, reference numeral 43 denotes a back pressure passage formed from the compression mechanism cover 9 to the compression mechanism housing 7. An orifice 44 as a pressure reducing section is installed in the back pressure passage 43. The back pressure passage 43 causes the inside of the discharge space 27 (the discharge side of the compression mechanism 4) in the compression mechanism cover 9 and the back pressure chamber 39 to communicate with each other, whereby as shown by an arrow in FIG. 1, the back pressure passage 43 is configured so that the refrigerant or oil (mainly oil) having discharge pressure adjusted to be reduced in pressure by the orifice 44 is supplied to the back pressure chamber 39.

The pressure (back pressure Pm) in the back pressure chamber 39 causes a back pressure load which presses the movable scroll 22 against the fixed scroll 21. Due to this back pressure load, the movable scroll 22 is pressed against the fixed scroll 21 against a compressive reaction force from the compression chamber 34 of the compression mechanism 4, so that the contacts between the laps 24 and 32 and the mirror plates 31 and 23 are maintained, thereby making it possible to compress the refrigerant in the compression chamber 34.

Further, in the embodiment, two back pressure holes 51 and 52 are cut in the mirror plate 31 of the movable scroll 22. Of these, the first back pressure hole 51 is formed between the laps at a position of approximately 90° from the outer end of the lap 32 of the movable scroll 22. The second back pressure hole 52 (back pressure hole) is formed between the laps at a position where the lap 32 is advanced by about 90° from the first back pressure hole 51 (FIGS. 2 to 5).

These back pressure holes 51 and 52 are holes for pressure control, which communicate the back pressure chamber 39 on the back side of the mirror plate 31 of the movable scroll 22 and the compression chamber 34 on the front surface side of the mirror plate 31. Basically, when the pressure (back pressure Pm) in the back pressure chamber 39 becomes excessive, the communication hole 51 allows the refrigerant to escape from the back pressure chamber 39 to the compression chamber 34 so that the back pressure Pm does not become excessive. Further, the oil in the back pressure chamber 39 is also returned to the compression chamber 34 at this time. This becomes extremely effective when the pressure in the discharge space 27 is reduced by the orifice 44 in the back pressure passage 43 and applied to the back pressure chamber 39 as in the embodiment.

The first back pressure hole 51 and the second back pressure hole 52 described above are cut at a predetermined position on the mirror plate 31 of the movable scroll 22 with a predetermined size (hole diameter). Next, the action of the first back pressure hole 51 and the second back pressure hole 52 will be described in detail with reference to FIGS. 2 to 8. The back pressure holes 51 and 52 are opened and closed by the lap 24 of the fixed scroll 21 as the movable scroll 22 revolves and turns with respect to the fixed scroll 21.

In the case of the embodiment, the first back pressure hole 51 is formed in positions and/or dimensions where the first back pressure hole opens inside the lap 24 of the fixed scroll 21 in a range of a crank angle (rotation angle of the rotating shaft 14) being 25° to 215°, and closes at other crank angles. The crank angle range in which the first back pressure hole 51 is open is made narrower than the above-mentioned conventional range (25° to 230°).

On the other hand, the second back pressure hole 52 opens inside the lap 32 of the movable scroll 22 in a range of a crank angle being 25° to 175° (first crank angle range). Thereafter, the second back pressure hole 52 is formed in positions and/or dimensions where when the crank angle is in the range of 175° to 250°, the second back pressure hole is temporarily closed by the lap 24 of the fixed scroll 21 and then opens again inside the lap 24 of the fixed scroll 21 in the range of the crank angle being 250° to 310° (second crank angle range), and closes at other crank angles. That is, the second back pressure hole 52 is opened twice across the lap 24 of the fixed scroll 21. Further, the first crank angle range is made narrower than the above-mentioned conventional range (25° to 230°).

Figure 2:
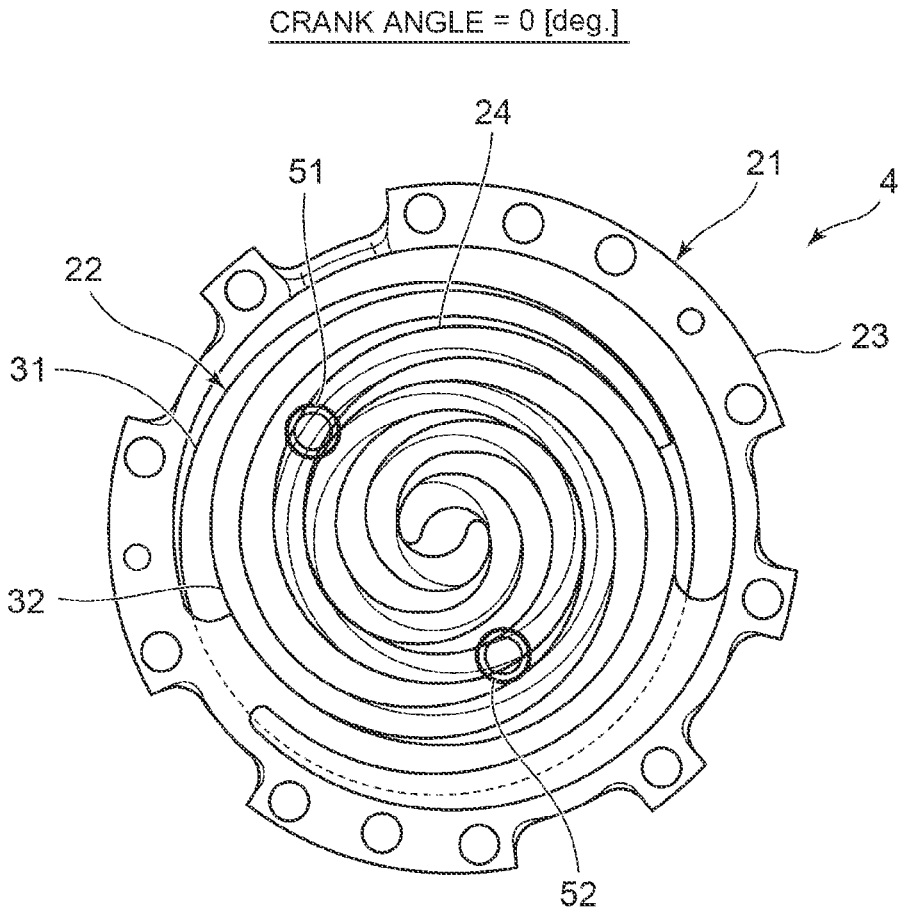
FIG. 2 is a diagram describing revolution turning motion of a movable scroll of the scroll compressor of FIG. 1 and the opening and closing of a back pressure hole (crank angle 0°)
Figure 3:
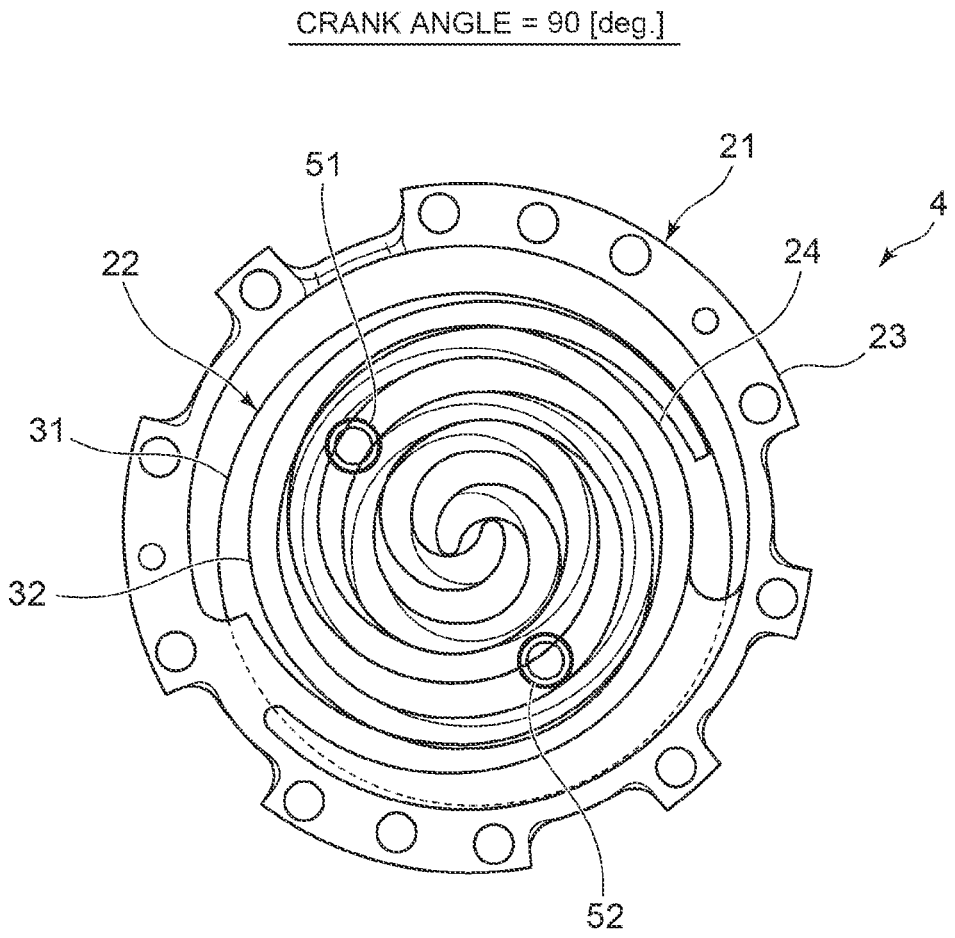
FIG. 3 is a diagram similarly describing revolution turning motion of the movable scroll and the opening and closing of the back pressure hole (crank angle 90°)
Figure 4:
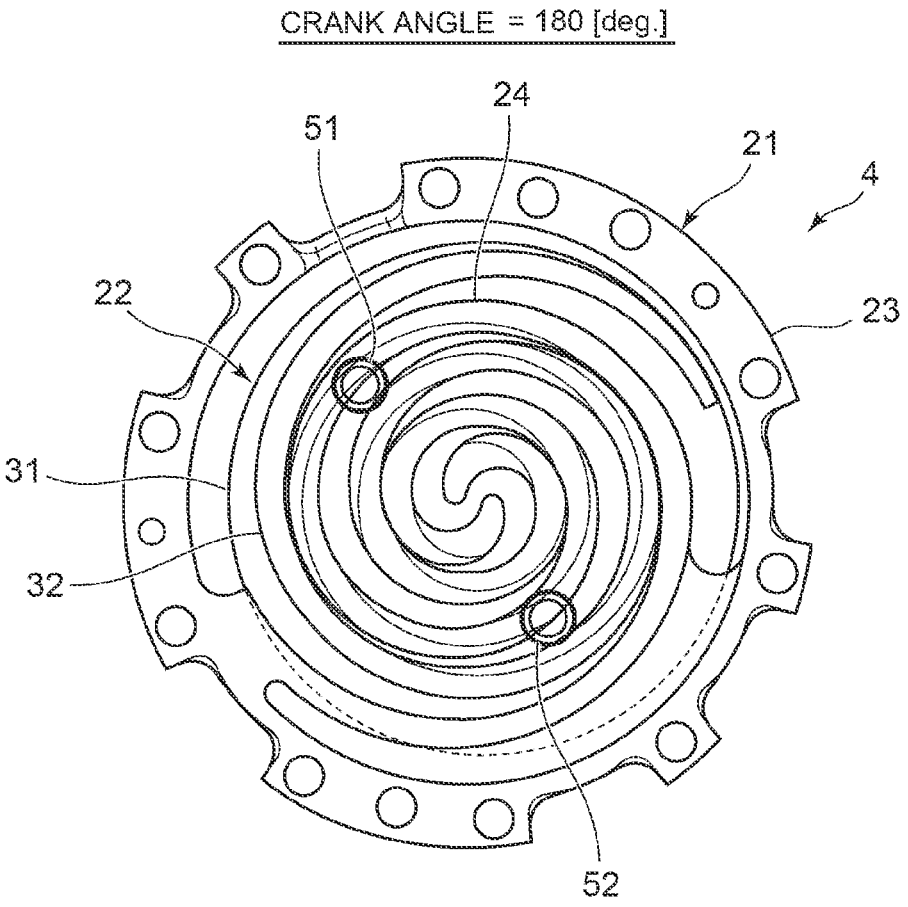
FIG. 4 is a diagram similarly describing revolution turning motion of the movable scroll and the opening and closing of the back pressure hole (crank angle 180°)
Figure 5:
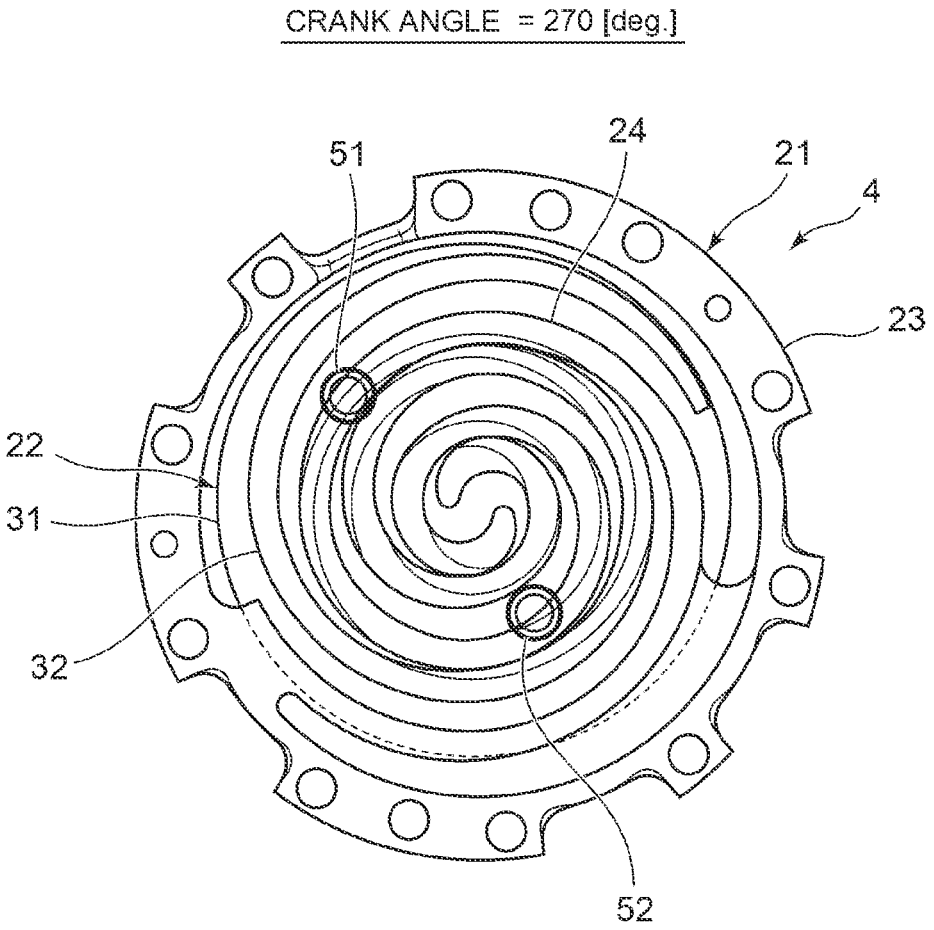
FIG. 5 is a diagram similarly describing revolution turning motion of the movable scroll and the opening and closing of the back pressure hole (crank angle 270°)

This situation will be described using FIGS. 2 to 5. FIG. 2 shows a state in which the crank angle is 0° (0 deg). In this state, both back pressure holes 51 and 52 are closed together. FIG. 3 shows a state in which the crank angle is 90°. In this state, the first back pressure hole 51 opens inside the lap 24 of the fixed scroll 21, and the second back pressure hole 52 opens inside the lap 32 of the movable scroll 22. FIG. 4 shows a state in which the crank angle is 180°. In this state, the first back pressure hole 51 is still open inside the lap 24 of the fixed scroll 21, but the second back pressure hole 52 is closed by lap 24 of the fixed scroll 21. Then, FIG. 5 shows a state in which the crank angle is 270°. In this state, the first back pressure hole 51 is closed by the lap 24 of the fixed scroll 21, but the second back pressure hole 52 straddles the lap 24 of the fixed scroll 21 and opens inside it.

Figure 6:
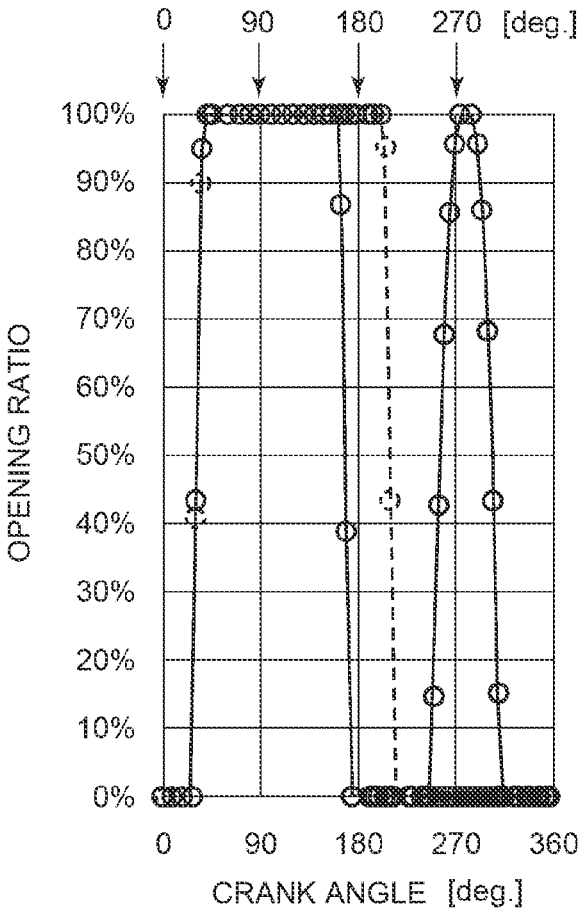
FIG. 6 is a diagram describing a crank angle of a rotating shaft of the scroll compressor of FIG. 1 and an opening ratio of the back pressure hole.

FIG. 6 shows the crank angle of the rotating shaft 14 and the opening ratios of the back pressure holes 51 and 52. In the figure, a broken line (that overlaps with a solid line between 25° and 175°) indicates the opening ratio of the first back pressure hole 51, and a solid line indicates the opening ratio of the second back pressure hole 52. As shown in this figure, the first back pressure hole 51 opens in the range of the crank angle of 25° to 215°, and the second back pressure hole 52 opens in the range of the crank angle of 25° to 175° (first crank angle range) and in the range of 250° to 310° (second crank angle range).

Figure 7:
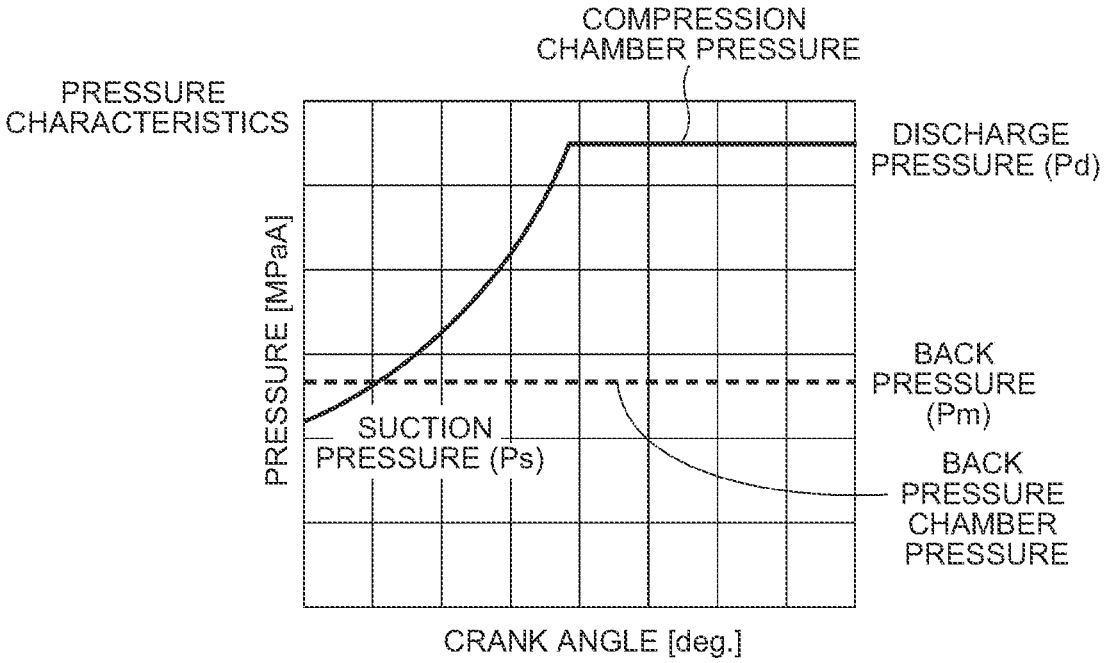
FIG. 7 is a diagram describing the pressure characteristics of a compression chamber of the scroll compressor of FIG. 1 and the opening characteristics of the back pressure holes (low-speed operation condition)
Figure 7:
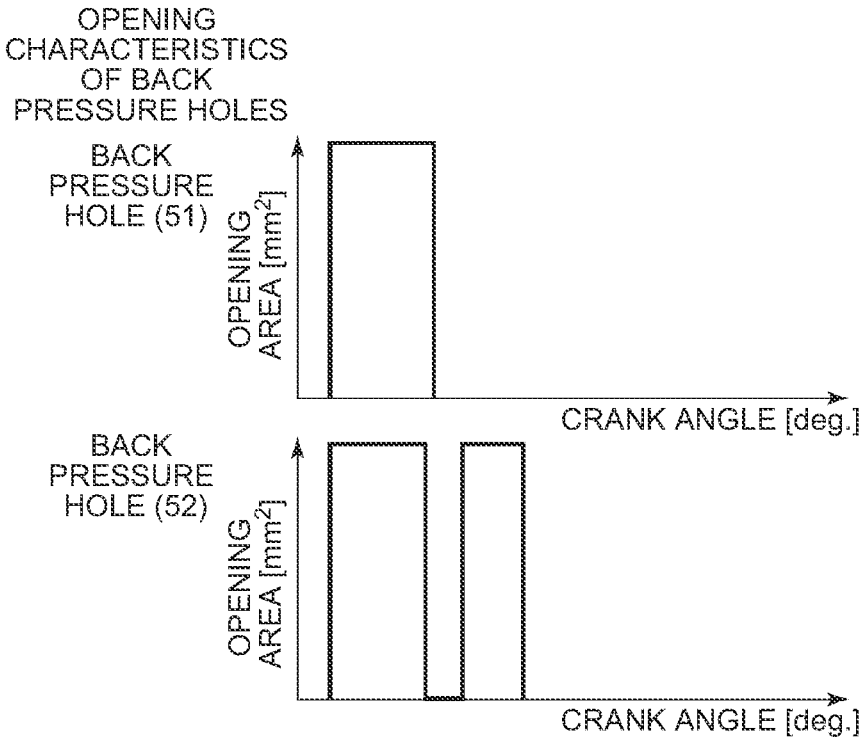
Figure 8:
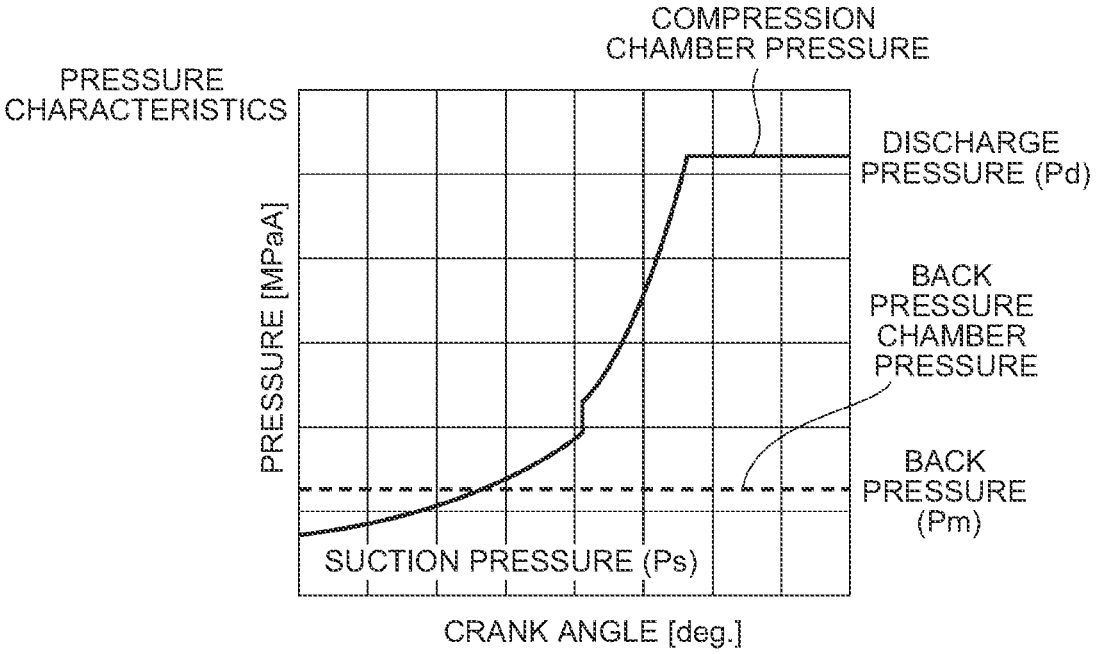
FIG. 8 is a diagram similarly describing the pressure characteristics of the compression chamber and the opening characteristics of the back pressure holes (operation condition low in suction pressure)
Figure 8:
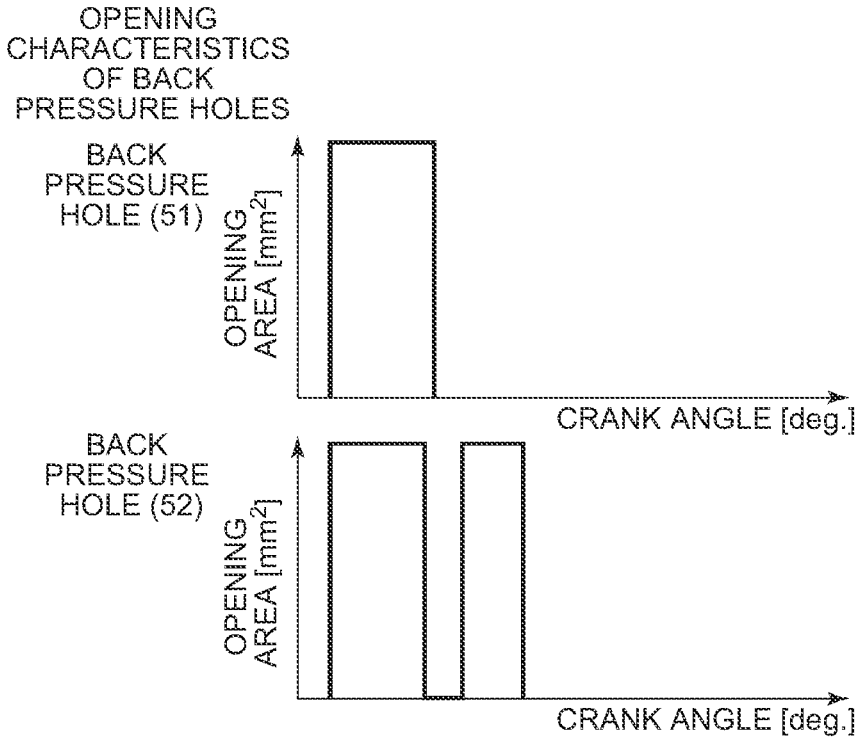
Figure 9:
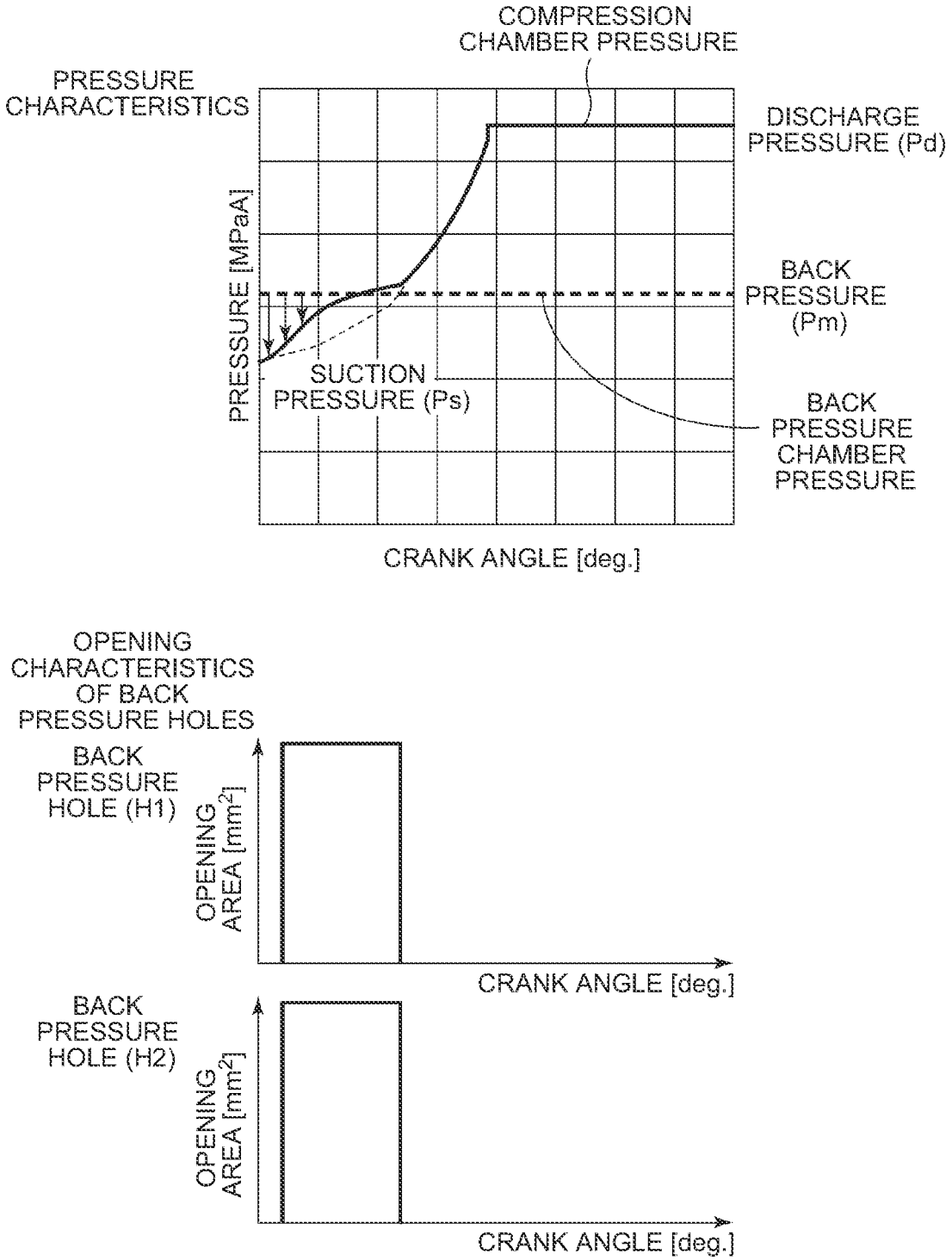
FIG. 9 is a diagram describing the pressure characteristics of a compression chamber of a conventional scroll compressor and the opening characteristics of a back pressure holes (low-speed operation condition)
Figure 10:
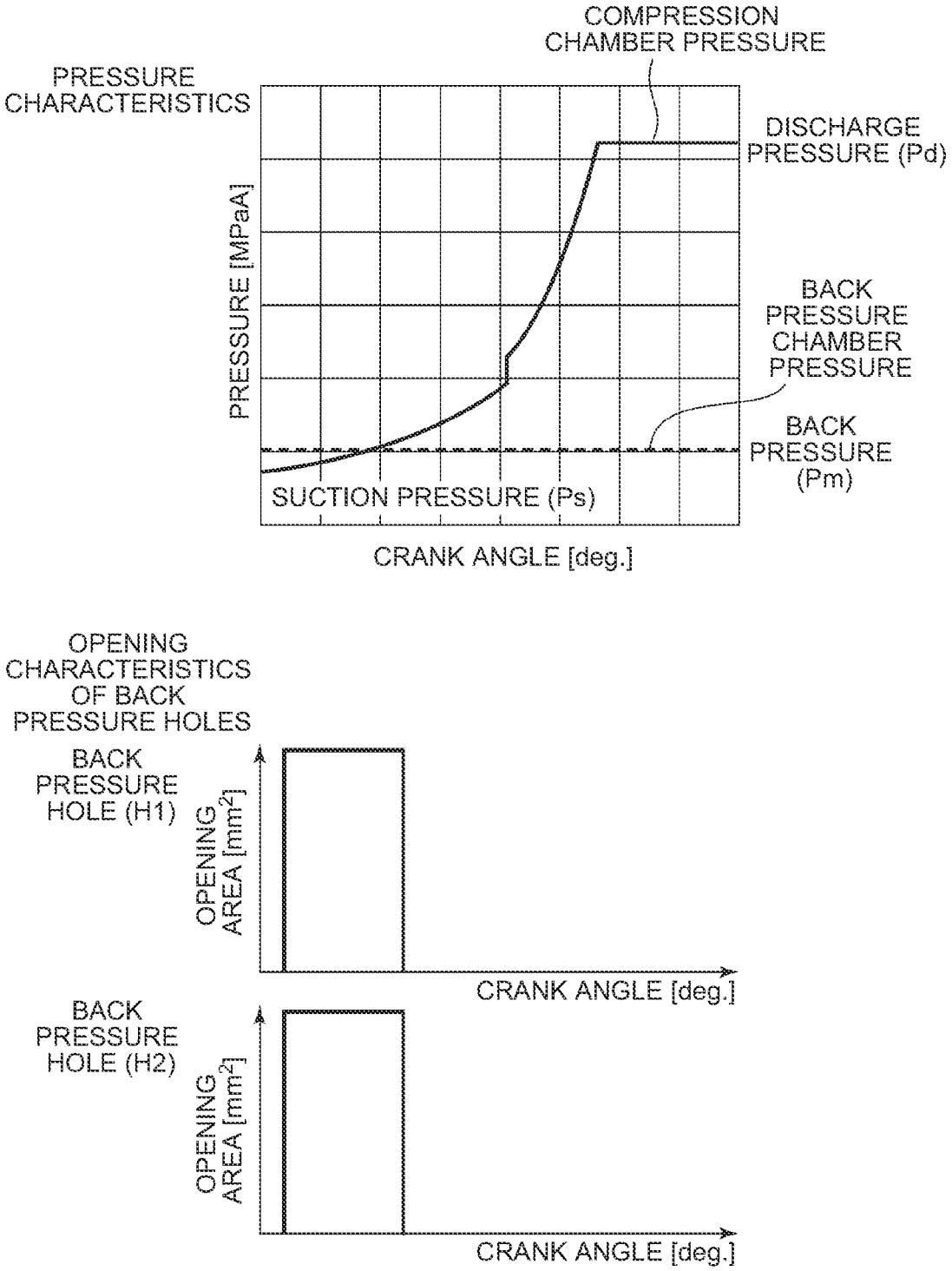
FIG. 10 is a diagram similarly describing the pressure characteristics of a conventional compression chamber and the opening characteristics of the back pressure holes (operation condition low in suction pressure).

Next, the action of the first back pressure hole 51 and the second back pressure hole 52 will be described with reference to FIGS. 7 and 8. As described above, the crank angle range (25° to 215°) at which the first back pressure hole 51 opens, and the crank angle range (first crank angle range 25° to 175°) at which the second back pressure hole 52 opens first are made narrower than the conventional range (25° to 230°). Therefore, the time at which both back pressure holes 51 and 52 open becomes short. Thus, it is possible to suppress the amount of the refrigerant and oil flowing from the back pressure chamber 39 into the compression chamber 34. Under a low-speed operation condition, as shown in FIG. 7, it becomes possible to suppress a rise in the back pressure Pm due to an increase in the compression chamber pressure.

On the other hand, since the second back pressure hole 52 is then reopened in the second crank angle range (250° to 310°), the back pressure chamber 39 and the compression chamber 34 are communicated with each other after the compression chamber pressure is sufficiently increased. Consequently, the higher compression chamber pressure can be supplied to the back pressure chamber 39, and a decrease in back pressure under an operation condition in which the suction pressure Ps becomes low can also be suppressed as shown in FIG. 8.

From the above, according to the present invention, while adjusting the back pressure to the appropriate back pressure Pm under both the low-speed operation condition and the operation condition low in suction pressure, and eliminating the inconvenience of excessively pressing the movable scroll 22 against the fixed scroll 21 under the low-speed operation condition to increase power consumption, and an increase in cost, it is also possible to eliminate the inconvenience that the back pressure Pm is lowered under the operation condition in which the suction pressure Ps becomes low, and the force to press the movable scroll 22 against the fixed scroll 21 runs short, thereby causing compression failure.

In this case, in the embodiment, the first back pressure hole 51 is opened in the range of the crank angle of 25° to 215°, and the second back pressure hole 52 is opened in the range of the crank angles of 25° to 175° and 250° to 310°. It is therefore possible to effectively adjust the back pressure Pm to an appropriate value.

Here, when the first back pressure hole 51 is formed more on the outer side so that the crank angle range in which the first back pressure hole 51 opens is further narrowed, this time, for example, the first back pressure hole 51 opens outside the lap 24 of the fixed scroll 21 in the state of the crank angle being 0° and communicates with the low-pressure compression chamber 34. However, in the embodiment, since the first back pressure hole 51 is formed in a position and/or dimension where after the first back pressure hole 51 is opened inside the lap 24 of the fixed scroll 21, it is closed by the lap 24 of the fixed scroll 21 and then is not opened outside the lap 24 of the fixed scroll 21, whereby no such inconvenience occurs either.

Further, the above configuration is extremely suitable for the back pressure passage 43 that communicates the discharge side of the compression mechanism 4 with the back pressure chamber 39 and the scroll compressor 1 in which the orifice 44 is provided in the back pressure passage 43 as in the embodiment.

Incidentally, in the embodiment, the first back pressure hole 51 and the second back pressure hole 52 are formed in the mirror plate 31 of the movable scroll 22, respectively, but the inventions of claims 1 and 2 are not limited thereto. Only the second back pressure hole 52 may be used. Further, the numerical values shown in the embodiment are not limited thereto in the invention of claim 1, and should be appropriately set according to the use, function, and capacity of the scroll compressor.

Further, in the embodiment, the present invention is applied to the scroll compressor used in the refrigerant circuit of the vehicle air conditioning device, but is not limited thereto. The present invention is effective for a scroll compressor used in each of refrigerant circuits of various refrigerating devices. Further, in the embodiment, the present invention is applied to the so-called inverter-integrated scroll compressor, but is not limited thereto. The present invention can also be applied to a normal scroll compressor not integrally provided with an inverter.

DESCRIPTION OF REFERENCE NUMERALS

1 scroll compressor
4 compression mechanism
14 rotating shaft
21 fixed scroll
22 movable scroll
23, 31 mirror plate
24, 32 lap
27 discharge space (discharge side)
34 compression chamber
39 back pressure chamber
43 back pressure passage
44 orifice (pressure reducing section)
51 first back pressure hole
52 second back pressure hole

The invention claimed is:

1. A scroll compressor having a compression mechanism constituted of a fixed scroll and a movable scroll respectively formed at surfaces of mirror plates with spiral laps facing each other, and in which the movable scroll is revolved and turned with respect to the fixed scroll to thereby compress a working fluid in a compression chamber formed between the laps of both scrolls, comprising:

a back pressure chamber formed in a back surface of the mirror plate of the movable scroll; and a first back pressure hole and a second back pressure hole formed in the mirror plate of the movable scroll and communicating the back pressure chamber and the compression chamber with each other, wherein the first back pressure hole is formed in a position and/or dimension whereby the revolution turning motion of the movable scroll, the first back pressure hole is opened inside the lap of the fixed scroll and then closed by the lap of the fixed scroll, and wherein the second back pressure hole is formed in a position and/or dimension whereby the revolution turning motion of the movable scroll, after the second back pressure hole is opened inside the lap of the movable scroll in a predetermined first crank angle range, the second back pressure hole is temporarily closed by the lap of the fixed scroll and then opened inside the lap of the fixed scroll in a predetermined second crank angle range.

2. The scroll compressor according to claim 1, wherein the back pressure hole is opened in a range of crank angles 25° to 175° and 250° to 310°.

3. The scroll compressor according to claim 2, including a back pressure passage which communicates the discharge side of the compression mechanism and the back pressure chamber with each other, and a pressure reducing section provided in the back pressure passage.

4. The scroll compressor according to claim 1, wherein the first back pressure hole is formed in a position and/or dimension where by the revolution turning motion of the movable scroll, after the first back pressure hole is opened inside the lap of the fixed scroll, the first back pressure hole is closed by the lap of the fixed scroll and then is not opened outside the lap of the fixed scroll.

5. The scroll compressor according to claim 4, wherein the first back pressure hole is opened in the range of the crank angle of 25° to 215°, and the second back pressure hole is opened in the range of the crank angles 25° to 175° and 250° to 310°.

6. The scroll compressor according to claim 1, wherein the first back pressure hole is opened in the range of the crank angle of 25° to 215°, and the second back pressure hole is opened in the range of the crank angles 25° to 175° and 250° to 310°.

7. The scroll compressor according to claim 6, including a back pressure passage which communicates the discharge side of the compression mechanism and the back pressure chamber with each other, and a pressure reducing section provided in the back pressure passage.

8. The scroll compressor according to claim 1, including a back pressure passage which communicates the discharge side of the compression mechanism and the back pressure chamber with each other, and a pressure reducing section provided in the back pressure passage.

9. The scroll compressor according to claim 4, including a back pressure passage which communicates the discharge side of the compression mechanism and the back pressure chamber with each other, and a pressure reducing section provided in the back pressure passage.

* * * * *